US007513001B1

(12) United States Patent
Leach

(10) Patent No.: US 7,513,001 B1
(45) Date of Patent: Apr. 7, 2009

(54) MULTI-PURPOSE PILLOW WITH ATTACHED BLANKET

(76) Inventor: Jamie S. Leach, 130 E. 10th St., Ada, OK (US) 74820

( * ) Notice: Subject to any disclaimer, the term of this patent is extended or adjusted under 35 U.S.C. 154(b) by 95 days.

(21) Appl. No.: 11/764,250

(22) Filed: Jun. 18, 2007

(51) Int. Cl.
*A47G 9/10* (2006.01)

(52) U.S. Cl. ..... 5/655; 5/632

(58) Field of Classification Search ..... 5/655, 5/632, 922, 923, 636, 904
See application file for complete search history.

(56) References Cited

U.S. PATENT DOCUMENTS

| | | | |
|---|---|---|---|
| 395,043 | A | 12/1888 | Doremus |
| 416,970 | A | 12/1889 | Taylor |
| 726,164 | A | 4/1903 | Hogan et al. |
| 909,453 | A | 1/1909 | Pullman |
| 1,376,625 | A | 5/1921 | Johnston |
| 1,447,288 | A | 3/1923 | Emmerich |
| 1,577,586 | A | 3/1926 | Morehouse |
| 1,769,722 | A | 7/1930 | Sutton |
| 2,149,140 | A | 2/1939 | Gonzalez-Rincones |
| D124,296 | S | 12/1940 | Thompson |
| 2,279,867 | A | 4/1942 | Falk |
| 2,328,871 | A | 9/1943 | Woehler |
| 2,336,707 | A | 12/1943 | Thompson |
| 2,404,108 | A | 7/1946 | Stauffacher et al. |
| 2,404,505 | A | 7/1946 | Knecht |
| 2,429,350 | A | 10/1947 | Farrand |
| 2,451,007 | A | 10/1948 | White |
| 2,495,482 | A | 1/1950 | Rogatz |
| 2,502,486 | A | 4/1950 | Savrin |
| 2,544,896 | A | 3/1951 | Nidetch et al. |
| D162,858 | S | 4/1951 | McGlinchey |
| 2,626,407 | A | 1/1953 | Kurry |
| 2,652,183 | A | 9/1953 | Hlivka |
| 2,694,202 | A | 11/1954 | Macrides |

(Continued)

FOREIGN PATENT DOCUMENTS

| | | |
|---|---|---|
| JP | 20041949989 | 7/2004 |

(Continued)

OTHER PUBLICATIONS

U.S. Appl. No. 11/193,195, filed Aug. 1, 2005, Leach.

(Continued)

*Primary Examiner*—Alexander Grosz
(74) *Attorney, Agent, or Firm*—Mary M. Lee

(57) ABSTRACT

A multi-purpose pillow with attached blanket. The pillow comprises a body with one or more inwardly-turned arms. One edge of the blanket is attached to the pillow, and a pouch is formed in the pillow so that blanket is stowable inside. A pocket may be included for holding an MP3 player or other accessory. A flap wraps around the body to cover the pouch opening and the accessory pocket when the blanket is stowed. In its preferred embodiment, the pillow provides a convenient infant support pillow with a blanket that may be deployed beneath the pillow to provide a clean playing, napping or changing area or to spread over or wrap around the infant. This pillow also is a handy travel pillow for toddlers through adults, one of the arms serving as a head and neck cushion, while the body supports an MP3 player in a convenient position.

27 Claims, 4 Drawing Sheets

U.S. PATENT DOCUMENTS

| | | | |
|---|---|---|---|
| 2,694,204 | A | 11/1954 | Cross |
| 2,741,412 | A | 4/1956 | Hinkle |
| 2,795,802 | A | 6/1957 | Myers |
| 2,817,090 | A | 12/1957 | Toellner |
| 2,857,957 | A | 10/1958 | Gay |
| 2,880,424 | A | 4/1959 | Kalensky |
| D191,513 | S | 10/1961 | Kerr |
| 3,088,438 | A | 5/1963 | Oliphant |
| D201,492 | S | 6/1965 | Jacobson |
| 3,239,271 | A | 3/1966 | Bergersen |
| 3,298,035 | A | 1/1967 | Gobins |
| 3,327,330 | A | 6/1967 | McCullough |
| 3,392,737 | A | 7/1968 | Fefferman |
| 3,604,026 | A | 9/1971 | Scheips |
| 3,604,750 | A | 9/1971 | Doering |
| 3,671,977 | A | 6/1972 | Degnon |
| 3,713,692 | A | 1/1973 | McCracken et al. |
| D227,423 | S | 6/1973 | Ando |
| 3,773,287 | A | 11/1973 | Hechinger |
| D230,804 | S | 3/1974 | Lijewski |
| 3,840,916 | A | 10/1974 | Jennings |
| 3,848,281 | A | 11/1974 | Matthews |
| 3,899,210 | A | 8/1975 | Samhammer et al. |
| 3,899,797 | A | 8/1975 | Gunst |
| 3,911,512 | A | 10/1975 | Plate |
| D244,569 | S | 6/1977 | Laroye |
| 4,031,567 | A | 6/1977 | Planck |
| 4,037,764 | A | 7/1977 | Almosnino et al. |
| 4,050,737 | A | 9/1977 | Jordan |
| 4,173,048 | A | 11/1979 | Varaney |
| 4,194,254 | A | 3/1980 | Torrez |
| 4,197,604 | A | 4/1980 | Nakamura |
| 4,227,270 | A | 10/1980 | Rivera |
| 4,235,474 | A | 11/1980 | Rosenberg |
| 4,236,264 | A | 12/1980 | Britzman |
| D259,902 | S | 7/1981 | Rock |
| 4,287,542 | A | 9/1981 | Okuda |
| D265,027 | S | 6/1982 | Meyers |
| D266,800 | S | 11/1982 | Kula et al. |
| 4,383,713 | A | 5/1983 | Roston |
| 4,393,530 | A | 7/1983 | Stark |
| 4,428,514 | A | 1/1984 | Elf |
| 4,434,920 | A | 3/1984 | Moore |
| 4,506,396 | A | 3/1985 | Ritchie, Jr. et al. |
| 4,550,459 | A | 11/1985 | Endel et al. |
| 4,574,412 | A | 3/1986 | Smith |
| D284,220 | S | 6/1986 | Pote |
| 4,592,589 | A | 6/1986 | Hellwig |
| 4,606,078 | A | 8/1986 | Tkacsik |
| 4,606,087 | A | 8/1986 | Alivizatos |
| 4,624,021 | A | 11/1986 | Hofstetter |
| 4,654,907 | A | 4/1987 | Haugaard |
| 4,666,017 | A | 5/1987 | Zimmerman |
| 4,667,624 | A | 5/1987 | Smith |
| 4,670,923 | A | 6/1987 | Gabriel et al. |
| 4,676,198 | A | 6/1987 | Murray |
| 4,676,554 | A | 6/1987 | Harlick et al. |
| 4,685,163 | A | 8/1987 | Quillen et al. |
| 4,698,862 | A | 10/1987 | Mairs |
| 4,709,430 | A | 12/1987 | Nicoll |
| 4,712,258 | A | 12/1987 | Eves |
| 4,731,890 | A | 3/1988 | Roberts |
| 4,754,509 | A | 7/1988 | Pollard |
| 4,754,510 | A | 7/1988 | King |
| 4,757,925 | A | 7/1988 | Knittel |
| 4,763,369 | A | 8/1988 | Spector |
| 4,788,726 | A | 12/1988 | Rafalko |
| 4,790,035 | A | 12/1988 | Whyte |
| 4,794,657 | A | 1/1989 | Avery |
| 4,796,315 | A | 1/1989 | Crew |
| D299,988 | S | 2/1989 | Parabita |
| 4,827,542 | A | 5/1989 | Kurtenbach |
| 4,834,459 | A | 5/1989 | Leach |
| 4,836,605 | A | 6/1989 | Greenwood et al. |
| 4,840,144 | A | 6/1989 | Voorhees et al. |
| 4,850,144 | A | 7/1989 | Grisham et al. |
| 4,853,994 | A | 8/1989 | Ekstein |
| 4,861,109 | A | 8/1989 | Leach |
| D303,897 | S | 10/1989 | Phillips |
| 4,871,210 | A | 10/1989 | Alexander et al. |
| 4,901,384 | A | 2/1990 | Eary |
| D306,948 | S | 4/1990 | Zollinger |
| D308,788 | S | 6/1990 | Boehm |
| D309,018 | S | 7/1990 | Leach |
| D310,609 | S | 9/1990 | Burkhardt |
| D313,141 | S | 12/1990 | Witter et al. |
| 4,980,937 | A | 1/1991 | Mason et al. |
| 4,986,458 | A | 1/1991 | Linday |
| 4,996,734 | A | 3/1991 | Rowe |
| 4,999,863 | A | 3/1991 | Kane |
| 4,999,866 | A | 3/1991 | Lindsey |
| 5,026,315 | A | 6/1991 | Chap |
| D318,202 | S | 7/1991 | Weber |
| 5,035,013 | A | 7/1991 | Bloom |
| D318,969 | S | 8/1991 | Byrn |
| 5,048,136 | A | 9/1991 | Popitz |
| 5,088,141 | A | 2/1992 | Meyer et al. |
| 5,097,551 | A | 3/1992 | Smith |
| 5,103,514 | A | 4/1992 | Leach |
| 5,109,557 | A | 5/1992 | Koy et al. |
| 5,115,524 | A | 5/1992 | Antosko |
| 5,119,767 | A | 6/1992 | Jimenez |
| 5,154,649 | A | 10/1992 | Pender |
| 5,159,727 | A | 11/1992 | McCracken |
| 5,161,260 | A | 11/1992 | Reynolds |
| 5,165,130 | A | 11/1992 | Wendling |
| 5,178,309 | A | 1/1993 | Bicheler et al. |
| 5,179,741 | A | 1/1993 | Book |
| D332,865 | S | 2/1993 | Wilmink |
| 5,187,309 | A | 2/1993 | Esch et al. |
| 5,193,238 | A | 3/1993 | Clute |
| 5,216,772 | A | 6/1993 | Clute |
| D339,923 | S | 10/1993 | Clarke |
| 5,249,308 | A | 10/1993 | Blume |
| 5,261,134 | A | 11/1993 | Matthews |
| D342,615 | S | 12/1993 | Asher |
| 5,269,323 | A | 12/1993 | Krouskop |
| 5,272,780 | A | 12/1993 | Clute |
| 5,310,245 | A | 5/1994 | Lyszczasz |
| 5,325,818 | A | 7/1994 | Leach |
| 5,339,472 | A | 8/1994 | Yin |
| 5,341,531 | A | 8/1994 | Straub et al. |
| 5,363,524 | A | 11/1994 | Lang |
| 5,365,613 | A | 11/1994 | Henegan |
| 5,371,909 | A | 12/1994 | McCarty |
| D355,306 | S | 2/1995 | Moses |
| 5,439,008 | A | 8/1995 | Bowman |
| D365,241 | S | 12/1995 | Braden et al. |
| 5,473,785 | A | 12/1995 | Lager et al. |
| D366,368 | S | 1/1996 | McCarthy |
| 5,490,528 | A | 2/1996 | Day |
| D369,054 | S | 4/1996 | Straub et al. |
| D369,934 | S | 5/1996 | Straub et al. |
| 5,519,906 | A | 5/1996 | Fanto-Chan |
| D370,585 | S | 6/1996 | Faithfull |
| 5,522,528 | A | 6/1996 | Petricola |
| 5,546,620 | A | 8/1996 | Matthews |
| 5,551,109 | A | 9/1996 | Tingley et al. |
| D375,557 | S | 11/1996 | Dixon |
| 5,570,823 | A | 11/1996 | Lindy |
| 5,572,753 | A | 11/1996 | Ruscitto |
| 5,581,833 | A | 12/1996 | Zenoff |
| 5,586,351 | A | 12/1996 | Ive |
| D377,423 | S | 1/1997 | Latrella et al. |

D377,881 S 2/1997 Watt
5,621,919 A 4/1997 Graham
5,647,076 A 7/1997 Gearhart
D381,790 S 8/1997 Harris et al.
D382,435 S 8/1997 Schaffner et al.
5,661,861 A 9/1997 Matthews
5,664,271 A 9/1997 Bellavance
5,685,016 A 11/1997 Douglas
5,699,569 A 12/1997 Schwarz-Zohrer
D388,589 S 1/1998 Walker
5,708,982 A 1/1998 Armani
5,778,470 A 7/1998 Haider
5,813,066 A 9/1998 Gebhard et al.
5,826,287 A 10/1998 Tandrup
5,857,598 A 1/1999 Dunne
D408,676 S 4/1999 Straub et al.
D409,038 S 5/1999 Rojas, Jr. et al.
D412,234 S 7/1999 Cox
5,930,854 A 8/1999 O'Neill et al.
D413,751 S 9/1999 Alyea
5,946,725 A 9/1999 Shatzkin et al.
5,950,887 A 9/1999 Powell
D414,915 S 10/1999 Anderson
D416,745 S 11/1999 Noyes
5,978,990 A 11/1999 Akey
5,979,981 A 11/1999 Dunne et al.
5,987,674 A 11/1999 Schaffner et al.
D419,819 S 2/2000 Bartoli
D420,845 S 2/2000 Rumage
6,026,525 A 2/2000 Davis
6,038,720 A 3/2000 Matthews et al.
6,049,929 A 4/2000 Rawson
6,052,848 A 4/2000 Kelly
6,055,687 A 5/2000 Matthews
6,061,854 A 5/2000 Crowley
6,065,655 A 5/2000 Parewick
6,079,067 A 6/2000 Becker et al.
6,088,854 A 7/2000 Brownrigg
6,112,960 A 9/2000 Seering et al.
6,119,873 A 9/2000 Matthews
6,123,389 A 9/2000 O'Connor et al.
D431,745 S 10/2000 Jackson
6,141,805 A 11/2000 Fisher-Cohen et al.
6,205,600 B1 3/2001 Sedlack
6,213,362 B1 4/2001 Lorenzini et al.
D443,461 S 6/2001 Hall et al.
D444,981 S 7/2001 Hall et al.
D445,506 S 7/2001 Vinson et al.
D446,675 S 8/2001 Straub
6,279,185 B1 8/2001 Matthews
D447,376 S 9/2001 Kramer
D450,517 S 11/2001 Darling et al.
D453,653 S 2/2002 Tunnell
6,343,727 B1 2/2002 Leach
6,349,437 B1 2/2002 Horning
6,354,665 B1 3/2002 Ross
6,408,463 B1 6/2002 Palacio
6,412,128 B1 7/2002 Matthews
6,427,251 B1 8/2002 Leach
6,434,769 B1 8/2002 Koenig
6,434,770 B2 8/2002 Matthews Brown
6,453,493 B1 9/2002 Matthews Brown
6,457,195 B1 10/2002 Holste
6,463,608 B1 10/2002 Moe
6,484,337 B1 11/2002 Moe et al.
D467,117 S 12/2002 Guy
6,499,164 B1 12/2002 Leach
6,499,165 B1 12/2002 Morgillo
6,505,366 B1 1/2003 Lied
6,532,612 B2 3/2003 Matthews Brown
6,539,567 B1 4/2003 Bae
6,553,590 B1 4/2003 Leach
6,574,810 B2 6/2003 Mangiaracina
6,601,252 B1 8/2003 Leach
6,625,828 B2 9/2003 Matthews Brown
6,640,977 B2 11/2003 Matthews Brown et al.
6,658,681 B2 12/2003 Britto et al.
6,662,390 B1 12/2003 Berger
6,671,907 B1 1/2004 Zuberi
6,671,908 B2 1/2004 Brown et al.
6,685,024 B1 2/2004 Matthews
6,692,072 B2 2/2004 Nelson et al.
6,708,354 B1 3/2004 Carter et al.
6,711,770 B1 3/2004 Owens et al.
6,751,817 B1 6/2004 Leach
D492,533 S 7/2004 Cole
6,760,934 B1 7/2004 Leach
6,763,539 B1 7/2004 Bartley et al.
D493,964 S 8/2004 Low
6,802,092 B1 10/2004 Klein
6,814,405 B2 11/2004 Norman
6,851,143 B2 2/2005 Matthews Brown
6,857,150 B2 2/2005 Matthews Brown et al.
D503,063 S 3/2005 Bartle et al.
6,874,183 B1 4/2005 Taylor
6,892,406 B2 5/2005 Littlehorn
6,905,169 B1 6/2005 Donoghue
6,920,655 B2 7/2005 Mitchell
6,944,898 B2 9/2005 Matthews Brown et al.
7,000,273 B2 2/2006 Rivera-Wienhold et al.
7,000,274 B2 2/2006 Matthews Brown et al.
7,000,275 B2 2/2006 Matthews Brown et al.
7,000,766 B2 2/2006 Matthews Brown et al.
7,010,821 B1 3/2006 Leach
7,017,212 B2 3/2006 Matthews Brown
D518,989 S 4/2006 Clapp
7,055,196 B2 6/2006 Littlehorn
7,089,639 B2 8/2006 Matthews Brown et al.
7,114,206 B2 10/2006 Leach
7,127,760 B2 10/2006 Bartley et al.
7,131,156 B1 11/2006 Walker-Craft
7,146,663 B2 12/2006 Brown et al.
2002/0029422 A1 3/2002 Matthews
2004/0060116 A1 4/2004 Matthews Brown
2005/0210591 A1 9/2005 Mead et al.
2006/0031992 A1 2/2006 Moore
2007/0022526 A1 2/2007 Leach
2007/0028384 A1 2/2007 Leach
2007/0046084 A1 3/2007 Leach
2007/0151031 A1 7/2007 Leach

FOREIGN PATENT DOCUMENTS

WO PCT/US01/270768 A1 3/2002

OTHER PUBLICATIONS

U.S. Appl. No. 11/216,361, filed Aug. 31, 2005, Leach.
U.S. Appl. No. 11/324,387, filed Jan. 4, 2006, Leach.
U.S. Appl. No. 11/446,459, filed Jun. 5, 2006, Leach.
U.S. Appl. No. 11/511,160, filed Aug. 28, 2006, Leach.
U.S. Appl. No. 11/743,749, filed May 30, 2007, Leach.
Abstract JP 2004 194989, Jul. 15, 2004, ESPACENET.

MULTI-PURPOSE PILLOW WITH ATTACHED BLANKET

FIELD OF THE INVENTION

The present invention relates generally to pillows and particularly to pillows for infants and toddlers.

BACKGROUND OF THE INVENTION

There are many products that have simplified and improved the care of infants. Among these is the infant support pillow, which is used to support an infant in a sitting or semi-reclining position. These pillows are lightweight and portable and are especially useful when the caregiver and child are outside the home.

The pillow of this invention comes equipped with an attached blanket that is stowable in a pouch in the pillow. When deployed, the blanket provides a covered surface under the pillow, a light cover, or a snug wrap for the infant. When spread out under the pillow, the blanket provides a clean, soft area for playing or for setting other infant care accessories. It may also be used as a changing mat or as a sleeping pallet. The pillow is also useful as a travel pillow for a toddler or an adult. The pillow preferably includes a pocket for an accessory, such as an MP3 player. These and other features and advantages will be apparent from the following description and the attached drawings.

DETAILED DESCRIPTION OF THE PREFERRED EMBODIMENTS

Figure 1:
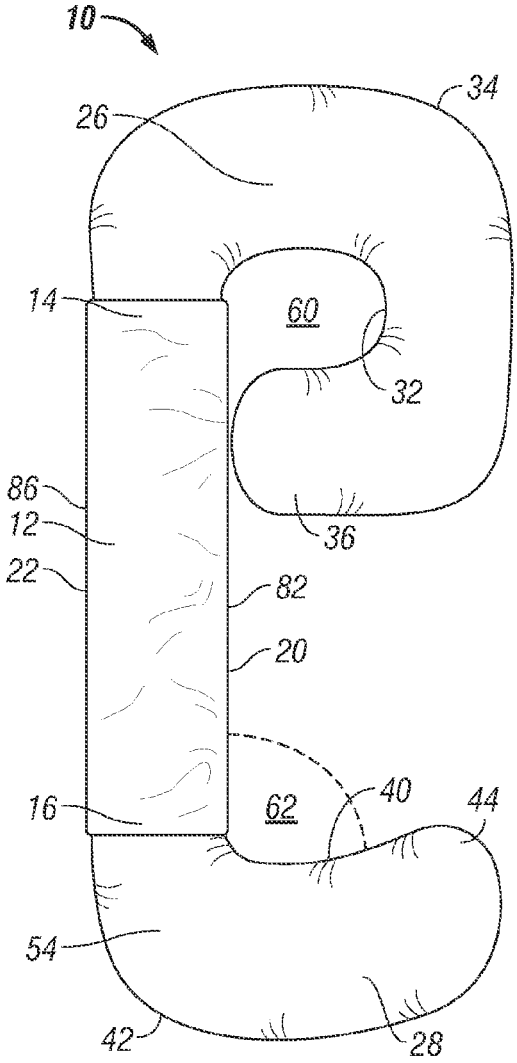
FIG. 1 is a plan view of a pillow made in accordance with the present invention. The pillow is shown in its resting position, with the blanket in the stowed position.
Figure 2:
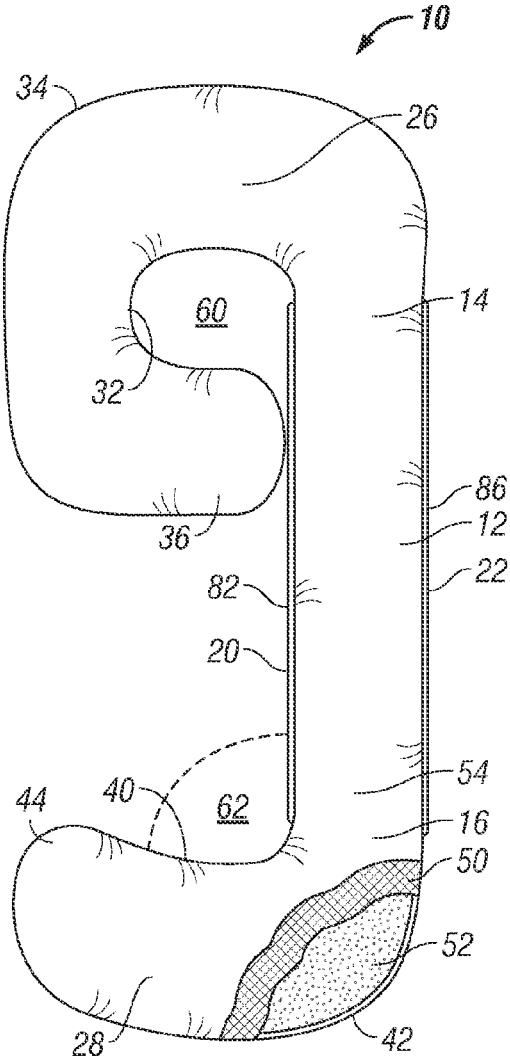
FIG. 2 is a bottom view of the pillow shown in FIG. 1.
Figure 3:
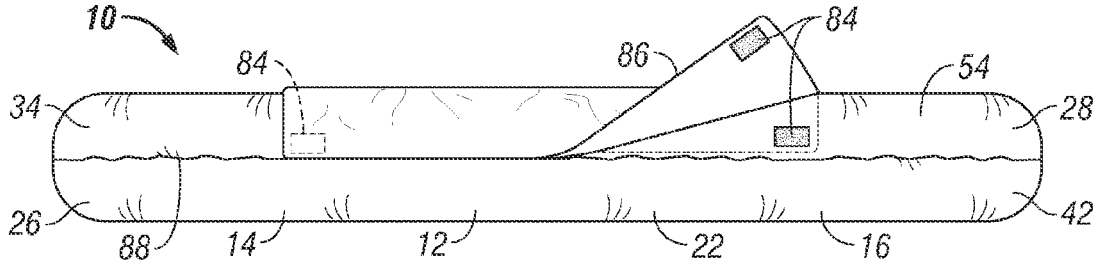
FIG. 3 is a side elevational view of the pillow shown in FIG. 1.

Turning now to the drawings in general and to FIGS. 1-3 in particular, there is shown therein a pillow made in accordance with a preferred embodiment of the present invention and designated generally by the reference numeral 10. The pillow 10 comprises a body 12 having a first end 14 and a second end 16. The body 12 has an inner perimeter 20 and an outer perimeter 22, as viewed from above in FIG. 1, defining a top half above the inner and outer perimeter and a bottom half below the inner and outer perimeter.

In its preferred form, the pillow 10 further comprises at least one and preferably two arms, such as the first and second arms 26 and 28. The first arm 26 extends from the first end 14 of the body 12. Like the body 12, the first arm 26 has an inner perimeter 32 and an outer perimeter 34. The first arm 26 terminates in a free end 36. The second arm 28 extends from the second end 16 of the body 12 and also has an inner perimeter 40 and an outer perimeter 42 and likewise terminates in a free end 44.

The body 12 and the first and second arms 26 and 28 all are formed of compressible resilient material so that the pillow provides good cushioning and returns to its original shape or resting position after being deformed. As used herein, "resting position" refers to the position and shape the pillow 10 naturally assumes when no tension or pressure is exerted on any part it.

Preferably, as seen in FIG. 2, the pillow 10 is formed by first sewing a fabric enclosure 50 in the desired configuration. The enclosure material may be any suitable fabric, including but not limited to waterproof nylon, flannel, or elastic fabrics, such as spandex or cotton-spandex blends. However, presently a polyester/cotton blend is preferred.

The enclosure 50 is filled with a compressible, resilient material 52. A preferred filler is polyester fiberfill. Other suitable fillers include down feathers, memory foam, polystyrene pellets. In some instances, an inflatable inner liner may be preferred. This construction provides a continuous compressible and resilient pillow form.

In this embodiment, a fabric cover 54 is also included. The cover 54 is formed similar to the enclosure, but may be designed for easy removal and cleaning. For example, the cover 54 may be provided with a zipper, buttons, snaps, ties, hook and loop connectors, or simply overlapping edges (not shown). Although the fabric of which the cover 54 is made may vary widely, a soft flannel fabric is highly preferred in most instances.

The ideal shape for the body 12 is generally cylindrical, that is generally circular in cross-section. Likewise the cross-sectional shape of the each of the arms 26 and 28 will be similar. The width of the body 12 and the arms 26 and 28 usually will be in the range of about 4 to about 6 inches, and the body may be slightly narrower so that its width will be about the same as the arms when the blanket is stowed in the pocket, as will be described in more detail hereafter. The length of the body 12 may vary as well, but a preferred length is between about 12 and about 24 inches, and more preferably is between about 16 and about 20 inches.

With continuing reference to FIGS. 1 and 2, the first arm 26 is configured so that its inner perimeter 32 forms, with inner perimeter 20 of the body 12, a multi-sided support area designated generally at 60, when the pillow 10 is in the resting position. In this preferred embodiment, the first arm 26 is curled or curved in towards the body 12 so that the terminal end 36 is adjacent the body, the arm having a generally toroidal shape. In this way, the support area 60 defined by the first arm 26 is a substantially enclosed well.

The well-shaped support area 60 may be virtually any shape, though usually the area will be generally circular, oval or square. The outer perimeter 34 may also take different shapes. For example, the outer perimeter 34 could be angular, such as square or polygonal, or it could be scalloped, without affecting the intended function of the pillow 10. However, in most instances it will have generally the same shape as the well-shaped support area 60.

Though the size or diameter of the well-shaped support area 60 may vary, it is advantageous to size the area to receive the torso of an infant. For example, a well having a diameter of about 4 to about 8 inches is ideal for use as an infant support pillow. This also allows the curved first arm 26 to fit around the neck of a larger child or adult for use as a head and neck cushion.

Like the first arm 26, the second arm 28 also preferably is configured so that its inner perimeter 40 forms, with inner perimeter 20 of the body 12, a multi-sided support area designated generally at 62, when the pillow 10 in the resting position. In this preferred embodiment, the support area 62 formed by second arm 28 is partially open, the second arm being generally perpendicular to the body 12. As shown herein, the second arm 28 and the body 12 together generally form an L-shape, though an open curve or other configuration may be used.

Now it will be seen that the arms 26 and 28 in the preferred embodiment shown and described herein are not symmetrical, that one forms a nearly closed well 60, while one forms an open or L-shaped bolster around the area 62. It will be understood, though, that a pillow with symmetrical arms is also contemplated by the present invention. Additionally, though the preferred embodiment has two arms 26 and 28, two arms are not essential to the present invention. Still further, although in the preferred embodiment, both arms 26 and 28 curve toward the same side of the body 12 (the inner perimeter 20 of the body 12 as in FIG. 1), other embodiments include a pillow in which the arms extend toward opposite sides of the body, similar to an S-shape.

Figure 5:
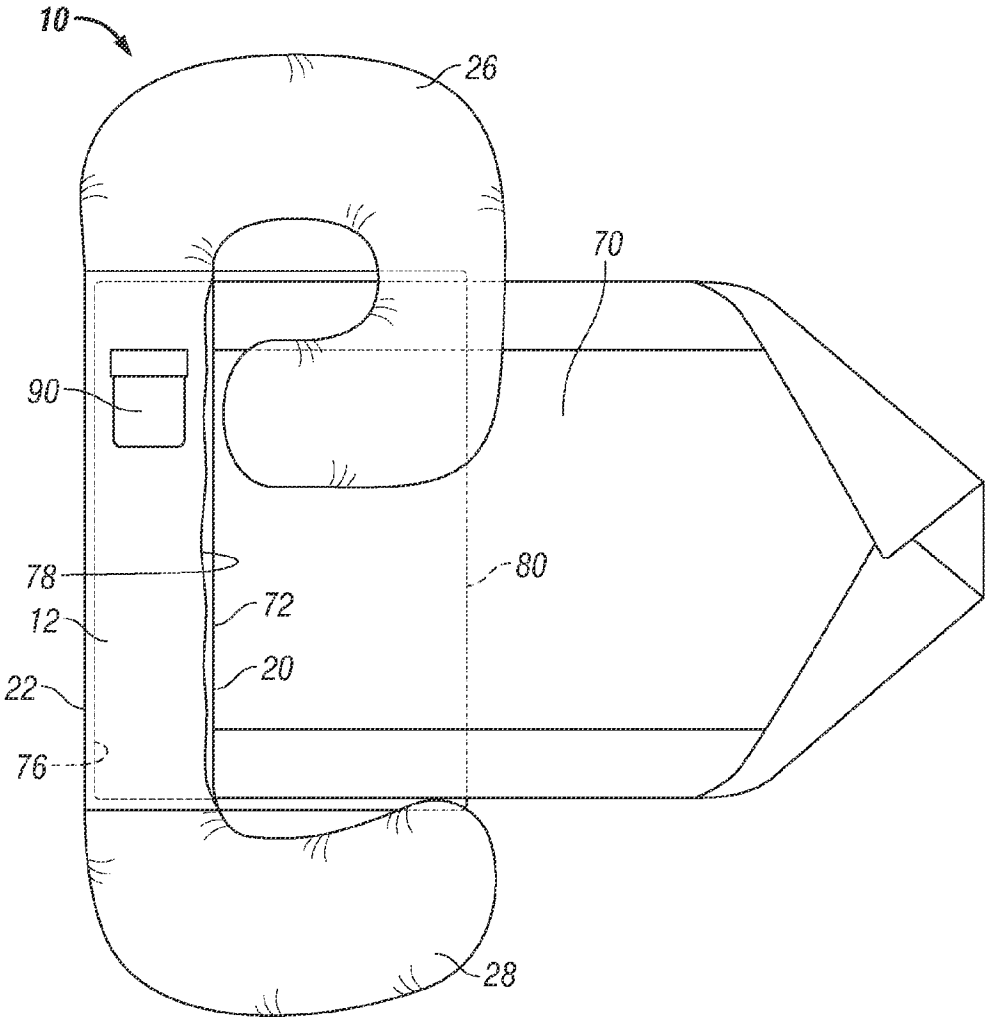
FIG. 5 is a plan view of the pillow with the pouch flap open and the blanket in a partially deployed position.
Figure 4:
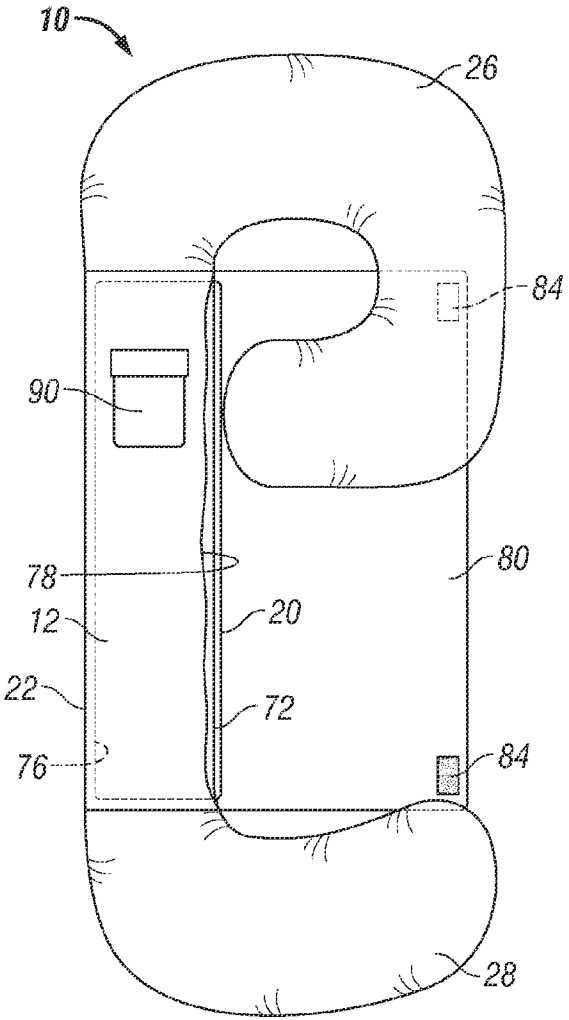
FIG. 4 is a plan view of the pillow in FIG. 1, with the pouch flap open.
Figure 6:
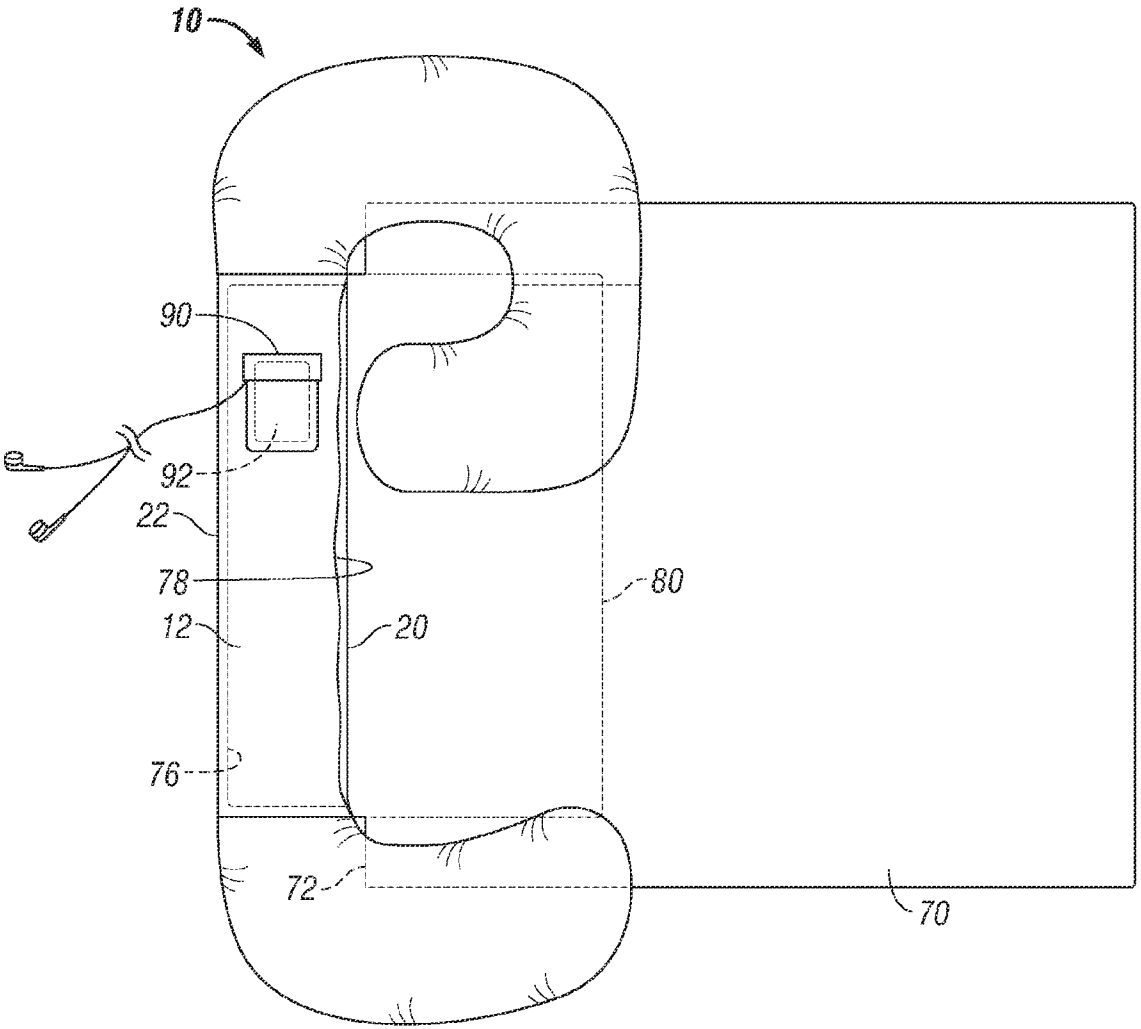
FIG. 6 is a plan view of the pillow with the blanket in the fully deployed position.

Turning now to FIGS. 4-6, the pillow 10 comprises a blanket 70. The shape and size of the blanket 70 may vary, but rectangular is a convenient shape and 24 inches by 28 inches is an ideal size for the pillow 10 as previously described. The blanket 70 may be made of the same fabric as the cover 54, or it may be a coordinating or a contrasting pattern or color, or even a different fabric.

The blanket 70 has a proximal edge 72 that is attached to the body 12, preferably along the inner perimeter 20. This attachment may be permanent, or the blanket 70 may be removable by attaching it with a zipper, buttons, snaps, ties, hook and loop connectors, or any other suitable attachment.

As indicated, the blanket 70 is stowable in the pillow 10. To that end, the pillow 10 includes a pouch 76 with an opening. Preferably, the pouch 76 is rectangular, but other shapes may be employed. The opening is most conveniently a long slot 78 that runs lengthwise along the body 12 adjacent the attached proximal edge 72 of the blanket 70. In the preferred embodiment, there is no closure on the slot 78. However, if desired, the slot could be equipped with a zipper, buttons, snaps, ties, hook and loop connectors, or any other suitable closure.

Especially where there is no closure on the slot 78 itself, it is often desirable to include a flap 80 to cover the slot. The flap 80 has a proximal edge 82 (FIGS. 1 & 2) attached to the body 12 very near where the blanket's edge 72 is attached. Similarly, though in the preferred practice of this invention, the flap 80 is permanently sewn or attached, the flap could be made removable by attaching it with a zipper, buttons, snaps, ties, hook and loop connectors, or any other suitable means.

The flap 80 is sized and positioned to cover the slot 78 (or other opening) when the flap is in the closed position, as seen in FIGS. 1-3, and to permit access to the pouch 76 through the slot (opening) when the flap is in the open position, shown in FIGS. 4-6. Some closure means, such as a zipper, buttons, snaps, ties, or the hook and loop fasteners 84 (FIGS. 3-5), as shown in the preferred embodiment, may be used to maintain the flap 80 in the closed position. Most desirable, the flap 80 is about the same length as the body 12 and is wide enough to extend over and cover a substantial portion of the top half of the body, so that its distal edge 86 is about even with the seam 88 along the outer perimeter 22 of the body. This provides a smooth area over the top of the body 12.

Now it will be apparent that the blanket 70 may be folded, rolled or otherwise retracted and pushed inside the pouch 76 into a stowed position, as seen in FIGS. 1-4. When desired, the blanket 70 may be unfolded, unrolled, or otherwise extended into a deployed position, as seen in FIGS. 5 and 6, spreading out a distance from the body 12.

Referring still to FIGS. 4-6, a pocket 90 may be included in the pillow 10 for holding an accessory. As shown herein, the accessory is an MP3 player 92. However, the accessory pocket 90 may be used to hold other accessories, such as a small wallet, car keys, a small toy, a packet of tissues, a pacifier, a bottle, a sippy cup, or virtually any other accessory that may be needed or desired by the baby or the caregiver. The pocket 90 will be sized and shaped accordingly. The placement of the pocket 90 may be virtually anywhere on the body 12 or either of the arms 26 and 28. However, a preferred placement is on the top of the body 12 near the slot 78, so that the flap 80 will cover the pocket 90 entirely when the flap is in the closed position.

Figure 7:
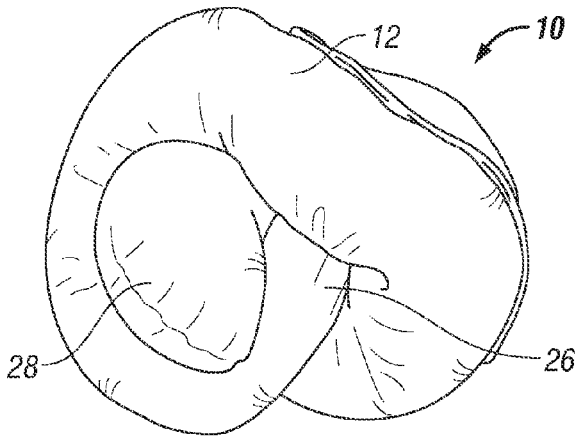
FIG. 7 is perspective view of the pillow in the storage or carrying position, with the blanket stowed and the arms knotted.

With reference now to FIG. 7, it will be seen that the shape of the pillow 10, combined with its compressibility and flexibility, allows the pillow to be twisted or tied in a knot as shown for convenient storage or for carrying. The pillow 10 readily springs back to its resting position (FIG. 1), when the arms 26 and 28 are unfolded.

Figure 8:
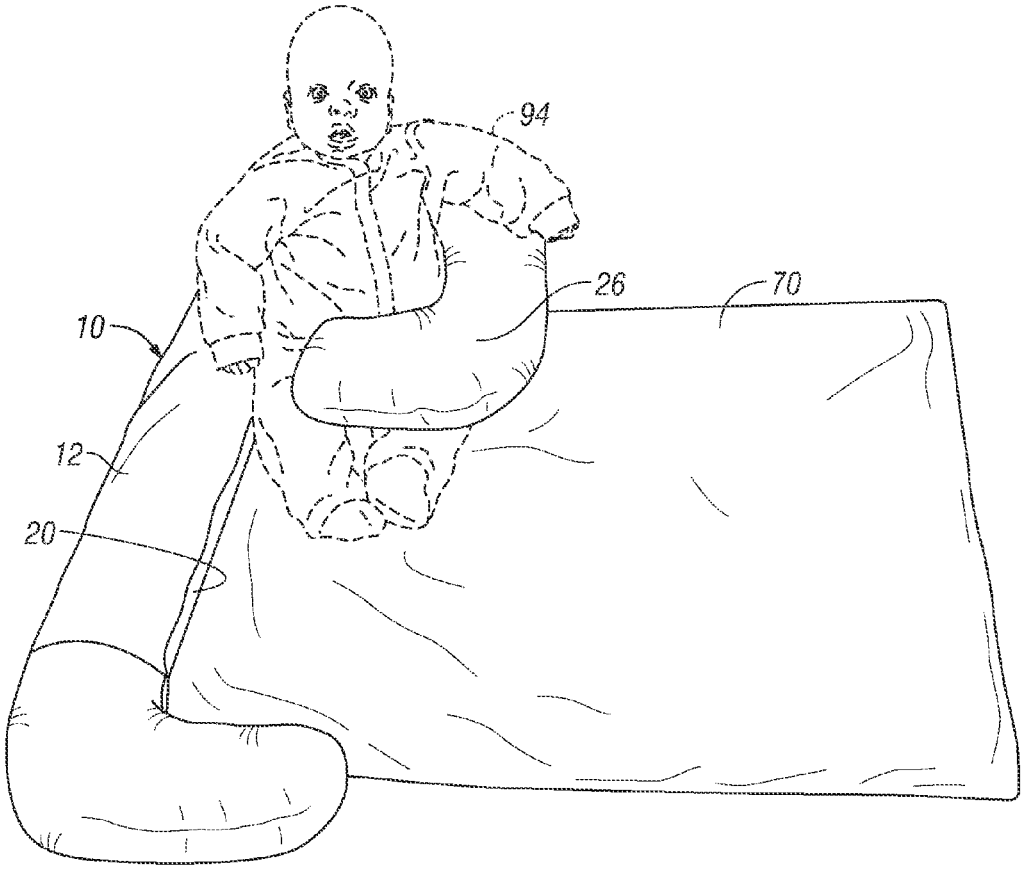
FIG. 8 is a perspective view of the pillow supporting an infant in one of the arms with blanket fully deployed beneath the infant.

Although the uses of this pillow 10 are many, one illustrative use is shown in FIG. 8. The blanket 70 has been deployed and spread out beneath the pillow 10, and an infant 94, shown in broken lines, is positioned in a semi-upright position inside the first arm 26.

Although not shown, it will be understood that the infant 94 could be laid flat on the blanket 70 for changing. Also, a very young infant could be placed on its side on the blanket 70 with its back propped up against the inner perimeter 20 of the body 12, in a SIDS-preventive position. A larger infant or toddler could be placed on the blanket 70 transverse or perpendicular to the body 12 with its head supported on the body. Still further, the blanket 70 could be laid over the infant 94 or wrapped around the infant. Yet another use for the pillow 10 is as a travel pillow for an older child or an adult. The toroidal first arm 26 makes an ideal head and neck cushion, and the pocket 90 (FIGS. 4-6) is conveniently placed for easy access to the MP3 player.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow comprising:

a body having a first end and a second end and having an inner perimeter and an outer perimeter, the body having a top half above the inner and outer perimeter and a bottom half below the inner and outer perimeter;

a first arm extending from the first end of the body and having an inner perimeter and an outer perimeter and terminating in a free end;

a pouch formed on the body and having an opening; and a blanket having a proximal edge attached to the body near the pouch opening, the blanket being retractable into a stowed position inside the pouch and extendable into a deployed position spreading out a distance from the body;

wherein the body and first arm are comprised of compressible, resilient material;

wherein the first arm is configured so that its inner perimeter forms with the inner perimeter of the body a multi-sided support area when the pillow is in the resting position; and a flap having a proximal edge attached to the body and being movable from an open position and a closed position, wherein in the open position the pouch opening is accessible, wherein in the closed position the pouch opening is covered, and wherein the flap is sized so that in the closed position the flap extends over and covers a substantial portion of the top half of the body.

2. The pillow of claim 1 wherein the pouch opening is a slot that runs lengthwise along the length of the body.

3. The pillow of claim 2 wherein the slot extends the entire length of the body and wherein the flap covers the entire top half of the body.

4. The pillow of claim 3 wherein the pillow comprises means for maintaining the flap in the closed position.

5. The pillow of claim 1 further comprising a second arm extending from the second end of the body and having an inner perimeter and terminating in a free end, the second arm being comprised of compressible, resilient material and being configured so that its inner perimeter forms with the inner perimeter of the body a multi-sided support area when the pillow is in the resting position.

6. The pillow of claim 5 wherein one of the first and second arms is configured so that its terminal end is adjacent the body and so that the multi-sided support formed by its inner perimeter defines a substantially enclosed well when the pillow is in the resting position.

7. The pillow of claim 6 wherein the well is sized to receive the torso of an infant.

8. The pillow of claim 5 further comprising an accessory pocket.

9. The pillow of claim 8 wherein one of the first and second arms is configured so that its terminal end is adjacent the body and so that the multi-sided support formed by its inner perimeter defines a substantially enclosed well when the pillow is in the resting position.

10. The pillow of claim 5 wherein the slot extends the entire length of the body and wherein the flap covers the entire top half of the body.

11. The pillow of claim 10 wherein one of the first and second arms is configured so that its terminal end is adjacent the body and so that the multi-sided support formed by its inner perimeter defines a substantially enclosed well when the pillow is in the resting position.

12. The pillow of claim 11 wherein the multi-sided support formed the first arm is on the same side of the body as the multi-sided support formed the second arm.

13. The pillow of claim 1 further comprising an accessory pocket.

14. The pillow of claim 13 wherein the slot extends the entire length of the body and wherein the flap covers the entire top half of the body.

15. The pillow of claim 14 wherein the accessory pocket is positioned on the body so that it will be covered entirely when the flap is in the closed position.

16. The pillow of claim 14 further comprising a second arm extending from the second end of the body and having an inner perimeter and terminating in a free end, the second arm being comprised of compressible, resilient material and being configured so that its inner perimeter forms with the inner perimeter of the body a multi-sided support area when the pillow is in the resting position.

17. The pillow of claim 1 wherein the slot extends the entire length of the body and wherein the flap covers the entire top half of the body.

18. The pillow of claim 17 wherein the first arm is configured so that its terminal end is adjacent the body and so that the multi-sided support formed by its inner perimeter defines a substantially enclosed well when the pillow is in the resting position.

19. The pillow of claim 18 further comprising an accessory pocket.

20. The pillow of claim 19 further comprising a second arm extending from the second end of the body and having an inner perimeter and terminating in a free end, the second arm being comprised of compressible, resilient material and being configured so that its inner perimeter forms with the inner perimeter of the body a multi-sided support area when the pillow is in the resting position.

21. The pillow of claim 1 wherein the first arm is configured so that its terminal end is adjacent the body and so that the multi-sided support formed by its inner perimeter defines a substantially enclosed well when the pillow is in the resting position.

22. The pillow of claim 21 comprising an accessory pocket.

23. The pillow of claim 22 wherein the accessory pocket is sized to hold an MP3 player.

24. The pillow of claim 1 wherein the blanket is permanently attached.

25. The pillow of claim 1 wherein the body is generally cylindrical in shape.

26. The pillow of claim 1 wherein the pillow comprises a fabric enclosure filled with a compressible, resilient filling.

27. The pillow of claim 26 wherein the pillow comprises a fabric cover, and wherein the pouch is formed in the fabric cover.

* * * * *